US006366304B1

(12) United States Patent
Nakayasu et al.

(10) Patent No.: US 6,366,304 B1
(45) Date of Patent: Apr. 2, 2002

(54) THERMAL CORRECTION FOR IMAGE-FORMING EXPOSURE DEVICE AND METHOD OF MANUFACTURING THE DEVICE

(75) Inventors: Hirofumi Nakayasu; Youji Houki; Yoshihiko Taira, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/583,560

(22) Filed: May 31, 2000

(30) Foreign Application Priority Data

Oct. 4, 1999 (JP) ..... 11-283393

(51) Int. Cl.[7] ..... B41J 2/385; G03G 13/04
(52) U.S. Cl. ..... 347/129; 347/238
(58) Field of Search ..... 347/115, 129, 347/130, 133, 138, 238, 241

(56) References Cited

U.S. PATENT DOCUMENTS 4,857,944 A * 8/1989 Hart et al.
5,274,394 A * 12/1993 Corona et al.
5,850,247 A 12/1998 Hamada et al. ..... 347/241
6,035,076 A * 3/2000 Nagase ..... 347/238 X
6,201,596 B1 * 3/2001 Sugita ..... 347/238 X

FOREIGN PATENT DOCUMENTS

JP 4-291376 10/1992
JP 9-277596 10/1997

* cited by examiner

*Primary Examiner*—Sandra Brase
(74) *Attorney, Agent, or Firm*—Armstrong, Westerman & Hattori, LLP

(57) ABSTRACT

The present invention aims at providing an exposure device, image-forming device, and manufacturing method of the exposure device that can reduce a color deviation and form a high-quality multicolor image. An interval of dots in an LED array that is most likely to undergo a thermal influence by radiant and conductive heat from a fixer is made smaller beforehand, whereby the color deviation that would otherwise be produced by the image-forming device is reduced.

18 Claims, 9 Drawing Sheets

THERMAL CORRECTION FOR IMAGE-FORMING EXPOSURE DEVICE AND METHOD OF MANUFACTURING THE DEVICE

BACKGROUND OF THE INVENTION

The present invention relates generally to exposure devices, image-forming devices, and manufacturing methods of the exposure devices. The present invention is suitable, for example, for an exposure device and electrophotographic recording device that utilize an LED for an optical system to form multicolor images. The "electrophotographic recording device" by which we mean is a recording device employing the Carlson process described in U.S. Pat. No. 2,297,691, as typified by a laser printer, and denotes a nonimpact image-forming device that provides recording by depositing a developer as a recording material on a recordable medium (e.g., printing paper, and OHP film). The electrophotographic recording device capable of forming multicolor images, which is also called a color tandem printer, typically uses a plurality of optical heads, and arranges a plurality of image-forming units each having such a head in tandem. The inventive image-forming device is applicable not only to a discrete printer, but also generally to various apparatuses having a printing function such as a photocopier, a facsimile unit, a computer system, word processor, and a combination machine thereof.

With the recent development of office automation, the use of electrophotographic recording devices for computer's output terminals, facsimile units, photocopiers, etc. has spread steadily. Specifically, fields of color laser printers and PPC color copiers having an image-processing feature that combines microprocessors with color scanners, for example, are expected to increasingly demand multicolor printing rather than mono-color printing in the near future.

The electrophotographic recording device capable of multicolor printing typically includes a plurality of image-forming units and one fixer. Each image-forming unit and the fixer are generally aligned in line. Since multicolor images are normally formed by a combination of cyan (C), magenta (M), yellow (Y), and black (K), four image-forming units are provided in general. Each image-forming unit generally includes a photoconductive insulator (photosensitive drum), a (pre-) charger, an exposure device, and a transfer part.

The charger electrifies the photosensitive drum uniformly (e.g., at −600 V). The exposure device, using an optical system such as an LED, irradiates a light from its light source, and varies a potential on an irradiated area, for example, to −50 V or so, forming electrostatic latent images on the photosensitive drum. The LED optical system is a device in which LED chips by the number of recording pixels are placed in line to make exposure to light through an unmagnified erect image-forming optical system such as SELFOC™ lens array, and a beam from an LED array is led, for instance, onto the photosensitive drum with the SELFOC™ lens array.

A development device electrically deposits a developer onto the photosensitive drum using, for example, a reversal process, and visualizes a latent image into a toner image. The reversal process is a development method that forms an electric field by a development bias in areas where electric charge is eliminated by exposure to light, and deposits the developer having the same polarity as uniformly charged areas on the photosensitive drum by the electric field. The transfer part, for example, using a corona charger, transfers the toner image corresponding to the electrostatic latent image on the medium.

Each step of charging, exposure to light, development, and transfer is repeated four times for four colors with respect to four image-forming units, and thereby four-color multi-layered toner (toner multi-layers) are formed on the medium. Toner multi-layers are fixed on the medium using the fixer. To be more specific, the fixer melts and fixes the toner image by applying heat, pressure or the like, and forms a color image on the medium. The fixer for the multicolor image-forming device fixes toner multi-layers for four colors, and therefore requires higher fixing energy and thus generates more intense heat than that of a single-color image-forming device.

The post processes may include charge neutralization and cleaning on the photosensitive drum from which toner is transferred out, a collection and recycle and/or disposal of residual toner, etc. As described above, the multicolor image is expressed by a combination and superimpose of four colors.

A conventional multicolor image-forming device, however, would disadvantageously cause a thermal expansion of one exposure device under such an environment in temperature as different from other exposure devices, and results in a deviation of colors in a final image. A cause of such a color deviation lies in the exposure device nearest the fixer, and the color deviation would occur particularly in printing immediately after an idle period (i.e., suspension period). After diverse investigations, the present inventors have discovered that stored heat in the fixer causes the color deviation.

During continuous printing, four image-forming units are more or less uniformly influenced by heat generated in a whole device, and thus each exposure device thermally expands uniformly. However, the fixer has a feature that heat generated therein during a printing operation is not dissipated immediately after the suspension of continuous printing operation but stored inside for a long time. Thus, during idle time, the image-forming unit nearest to the fixer is heated by radiation and conduction of residual heat in the fixer, and other three image-forming units, as apart from the fixer, are cooled in sequence. In other words, the exposure device of the image-forming unit nearest to the fixer is put in an environment where its ambient temperature is higher than those of other three exposure devices during idle time. If the four exposure devices are thermally expanded in a nonuniform manner, areas to be exposed on the photosensitive drum does not match one another, causing a deviation of colors in a final image. The colors would be deviated greatly particularly in printing immediately after idle time.

On the other hand, in order to overcome the foregoing disadvantages, it is conceivable to cool the fixer by a high-performance cooler or thermally insulate the fixer from the exposure devices, but these would disadvantageously raise the size of the whole device and its price.

BRIEF SUMMARY OF THE INVENTION

Therefore, it is an exemplified general object of the present invention to provide a novel and useful exposure device, image-forming device and manufacturing method of the exposure device, in which the above conventional disadvantages are eliminated.

Another exemplified and more specific object of the present invention is to provide an exposure device, image-forming device and manufacturing method of the exposure device that can lessen the deviation of colors to form a higher-quality image.

In order to achieve the above objects, an exposure device as one exemplified embodiment of the present invention comprises a first exposure unit that emits a plurality of dots at a first interval between the dots onto a photoreceptor material, and a second exposure unit that emits a plurality of dots at a second interval between the dots different from the first interval between the dots onto the photoreceptor material, wherein the interval between the dots in a specified area of the second exposure unit is shorter than the interval between the dots in an area of the first exposure unit corresponding to the specified area. Alternatively, an interval between the dots in a chip of the second exposure unit is shorter than a corresponding interval between the dots in a corresponding chip of the first exposure unit. Further alternatively, an interval between two adjacent chips of the second exposure unit is shorter than an interval between corresponding two adjacent chips of the first exposure unit. This exposure device may allows the second exposure unit to be placed in such a position where the interval of dots is likely to expand by temperature or like environmental factors, and may help reduce the absolute value of a deviation of exposing position by the first and second exposure units.

An image-forming device as one exemplified embodiment of the present invention comprises a photosensitive body, an exposure device that exposes the photosensitive body to light and forms a latent image, and a fixing device that fixes a toner image corresponding to the latent image onto a recordable medium, wherein the exposure device may comprise any one of the above-described embodiments. This image-forming device, which has the above exposure device, may thus manifest the same effects.

A manufacturing method of an exposure device as an exemplified embodiment of the present invention comprises the steps of manufacturing a plurality of exposure units including a plurality of light-emitting elements having a specified interval of dots, measuring a manufacturing error of an interval from a standard position in the exposure unit on all of the plurality of exposure units, classifying some of the exposure units of which the manufacturing error is over a standard value into a first group and the other of the exposure units of which the manufacturing error is below the standard value into a second group, after the step of manufacturing, and selecting as a first exposure unit at least one exposure unit from the first group and as a second exposure unit at least one exposure unit from the second group and manufacturing an exposure device including the first and second exposure units. This method can economically manufacture the above exposure device utilizing a variation of manufacturing errors of the exposure units.

Other objects and further features of the present invention will become readily apparent from the following description of the embodiments with reference to accompanying drawings.

DETAILED DESCRIPTION OF THE INVENTION

Figure 1:
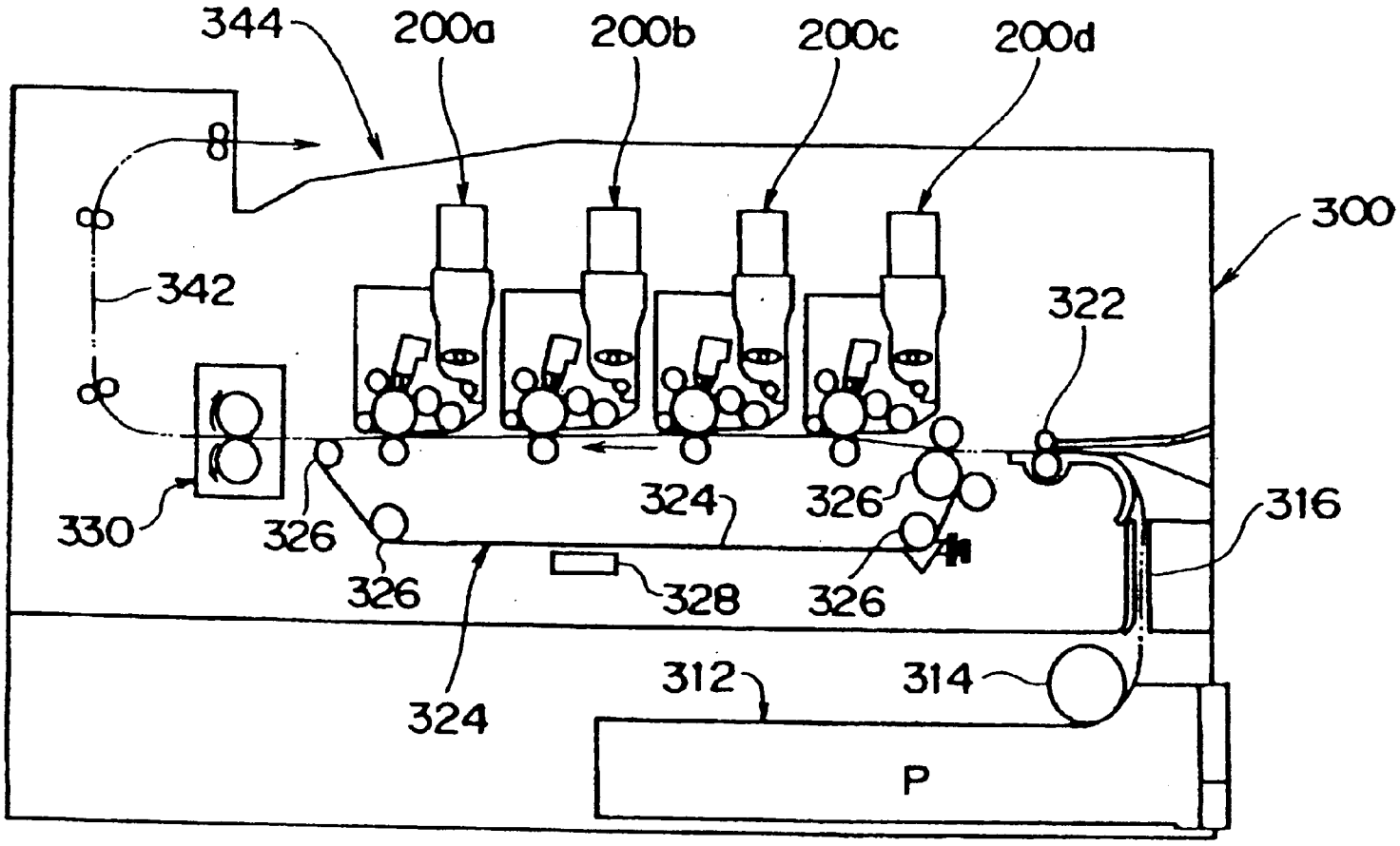
FIG. 1 is a schematic sectional view of a multicolor image-forming device having a plurality of image-forming units.

A description will now be given of a placement of image-forming units 200*a* to 200*d* having exposure devices 100*a* to 100*d* as one embodiment of the present invention, with reference to FIGS. 1. Like elements bear similar reference numerals, and a duplicate description thereof will be omitted. Like reference numerals with a capital alphabetic letter attached thereto generally designate a variation of the elements identified by the reference numerals, and reference numerals without an alphabetic letter, unless otherwise specified, comprehensively designate the element identified by the reference numerals with an alphabetic letter. Hereupon FIG. 1 is a schematic side sectional view of a multicolor image-forming device 300 having a plurality of image-forming units 200*a* to 200*d*. The multicolor image-forming device 300 includes a sheet-drawing section 310, a sheet conveyor section 320, four image-forming units 200*a* to 200*d*, a fixer 330, and a stacker 344. The present embodiment employs four colors of black (K), cyan (C), magenta (M), and yellow (Y), and black (K) is allotted to the image-forming device 200*a*, cyan (C) to the image-forming device 200*b*, magenta (M) to the image-forming device 200*c*, and yellow (Y) to the image-forming device 200*d*. It goes without saying that the number of colors in the present invention is not limited to four. Moreover, the image-forming unit 200 according to the present embodiment is, needless to say, applicable to both of single-sided and double-sided printings.

The sheet-drawing section 310 picks up a sheet of paper P placed on the top of a hopper (or tray) 312 storing more than one sheet of printing paper, and supplies it to the sheet conveyor section 320. The sheet-drawing section 310 includes the hopper 312, a pickup roller 314, and a sheet guide 316. The hopper 312 stores more than one sheet of paper P. The pickup roller 314 is brought into contact with a sheet of paper P on the top of a stack of paper P set in the hopper 312, and dispenses the sheets one by one. The sheet guide 316 guides the paper P dispensed by the pickup roller 314 to the sheet conveyor section 320.

The sheet conveyor section 320 receives the paper P from the sheet-drawing section 310, and conveys it along a sheet conveyor path 342 to the stacker 344. The sheet conveyor section 320 includes a sheet feed roller 322, a conveyer belt 324, and a driven roller 326 that rotates the conveyor belt 324. The paper P is conveyed to the conveyor belt 324 by the sheet feed roller 322. Subsequently, the paper P is electrostatically adsorbed to the conveyor belt 324 rotating to the left (counterclockwise) in FIG. 1 by the driven roller 326, conveyed between a photosensitive drum 210 in the image-forming unit 200 and the belt 324, passing through the fixer 330, and dispensed to the stacker 344.

Figure 8:
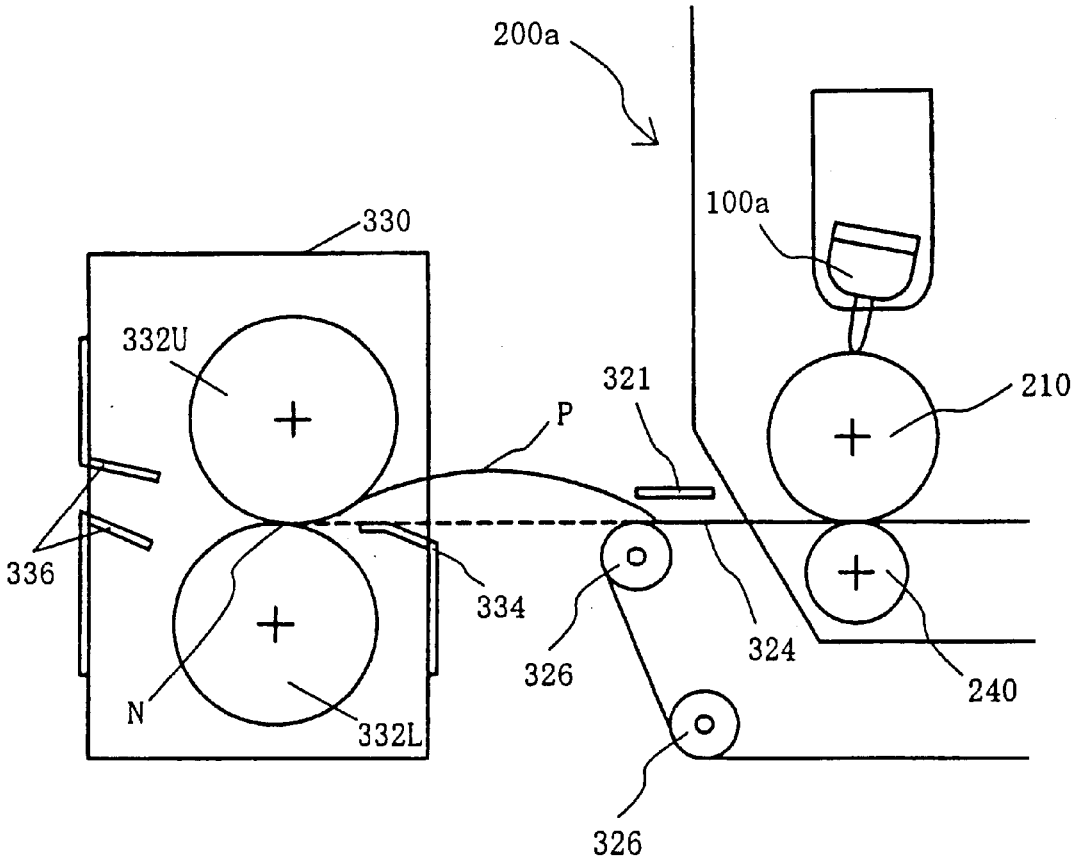
FIG. 8 is a magnified schematic side view for illustrating a part of sheet conveyor section 320 and a fixer 330 of the multicolor image-forming device shown in FIG. 1.

Referring now to FIG. 8, a description will be given of the fixer 330. FIG. 8 is a schematic side view of apart of the sheet conveyor section 320 and the fixer 330. The fixer 330 includes an upper fixing roller 332U and a lower fixing roller 332L, an inlet sheet guide 334, and an outlet sheet guide 336. FIG. 8 further illustrates an upper sheet guide 336 (not shown in FIG. 1) placed on the sheet conveyor belt 324. The upper fixing roller 332U and lower fixing roller 332L are so located as to run parallel to and keep in contact with each other, and a nip N is formed between them. The fixing rollers 332U and 332L are, depending upon their purposes, made of varied materials, among fluoric rubber, silicon rubber, and the like. The upper fixing roller 332 U and lower fixing roller 332L also includes a halogen lamp or the like as a heat source, and can heat, for instance, to 170° C. through 190° C. A thermistor is provided to detect surface temperatures of the rollers 332U and 332L. Moreover, a high pressure, e.g. , 33 atm., is to be applied between the upper fixing roller 332U and lower fixing roller 332L. Toner transferred onto the paper P is fixed by high temperature and high pressure.

The inlet sheet guide 334, outlet sheet guide 336, and upper sheet guide 321 provided as sheet guide mechanisms serve to precisely introduce or dispense the paper P onto which a toner image is transferred to or from the fixing rollers 332U and 332L.

As shown in FIG. 1, on a bottom belt surface of the conveyor belt 324 preferably is provided a sensor 328 parallel to a belt-moving direction. The sensor optically reads a register mark on the conveyor belt 324, and detects a misalignment of the conveyor belt 324.

Figure 2:
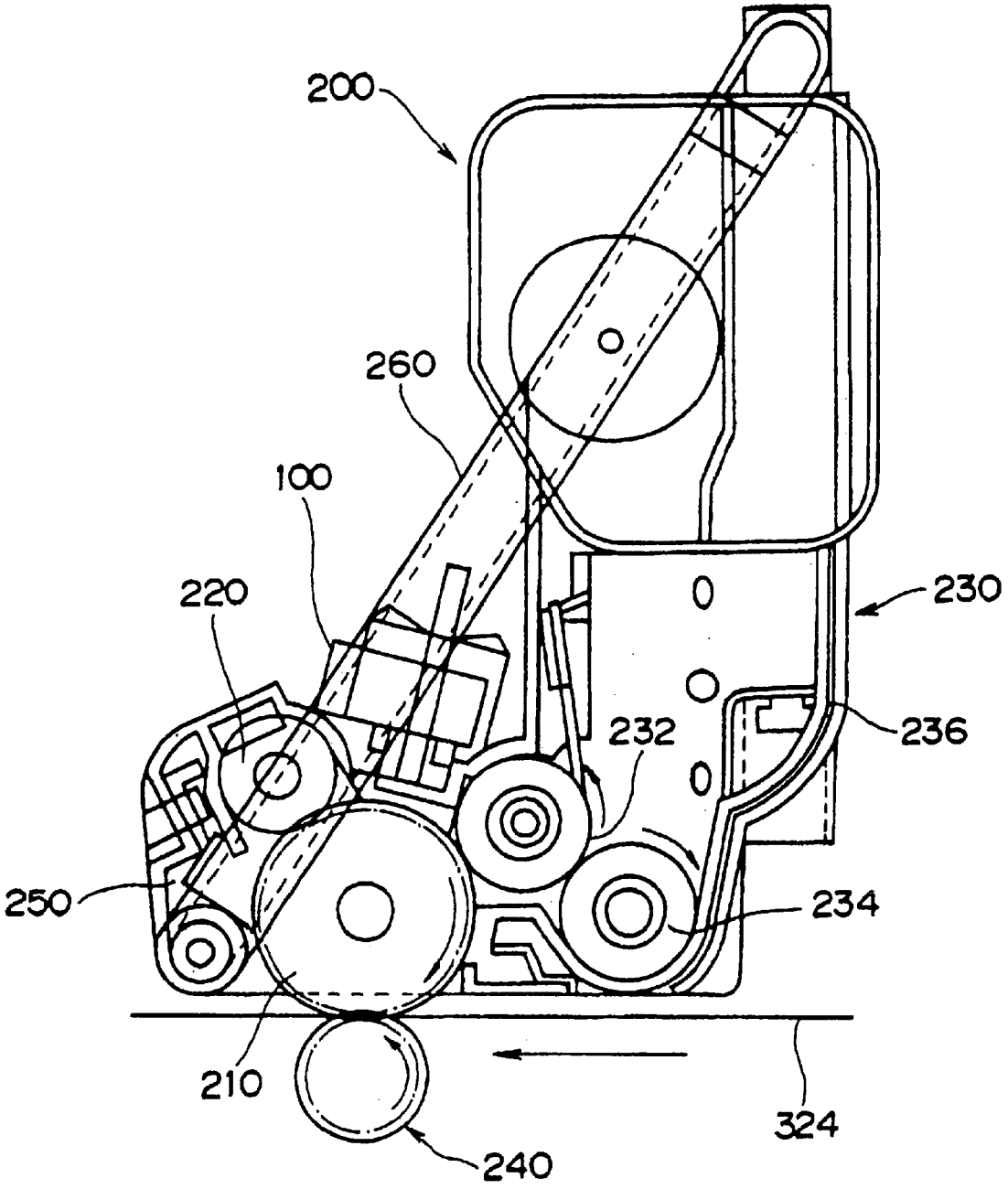
FIG. 2 is a schematic sectional view of the inventive image-forming unit shown in FIG. 1.

The image-forming unit 200 serves to form (transfer) a desired toner image on the printing paper P. As shown in FIG. 1, the four image-forming units 200*a* through 200*d* and fixer 330 are aligned in a straight line. The image-forming unit 200 is, as shown in FIG. 2, includes a photosensitive drum 210, a pre-charger 220, an exposure device 100, a development device 230, a transfer roller 240, a cleaning section 250, and a screw conveyor 260. FIG. 2 is a schematic sectional view of an exemplified embodiment of the image-forming unit 200. However, it is to be understood that the image-forming unit 200*a* shown in FIG. 1 includes the exposure device 100*a* that is different (in size) from other image-forming units 200*b* through 200*d*.

The photosensitive drum 210 includes a photosensitive dielectric layer on a rotatable drum-shaped conductor support, and is used for an image holding member. The photosensitive drum 210, which is, for instance, made by applying a function separation-type organic photoreceptor with a thickness of about 20ì m on a drum-shaped aluminum member, has an outer diameter of 30 mm, and rotates at a circumferential velocity of 70 mm/s to move in the arrow direction. The charger 220 is, for instance, comprised of a scorotron-electrifying device, and gives a constant amount of electric charges (e.g., about −700 V) on the photosensitive drum 210.

Figure 3:
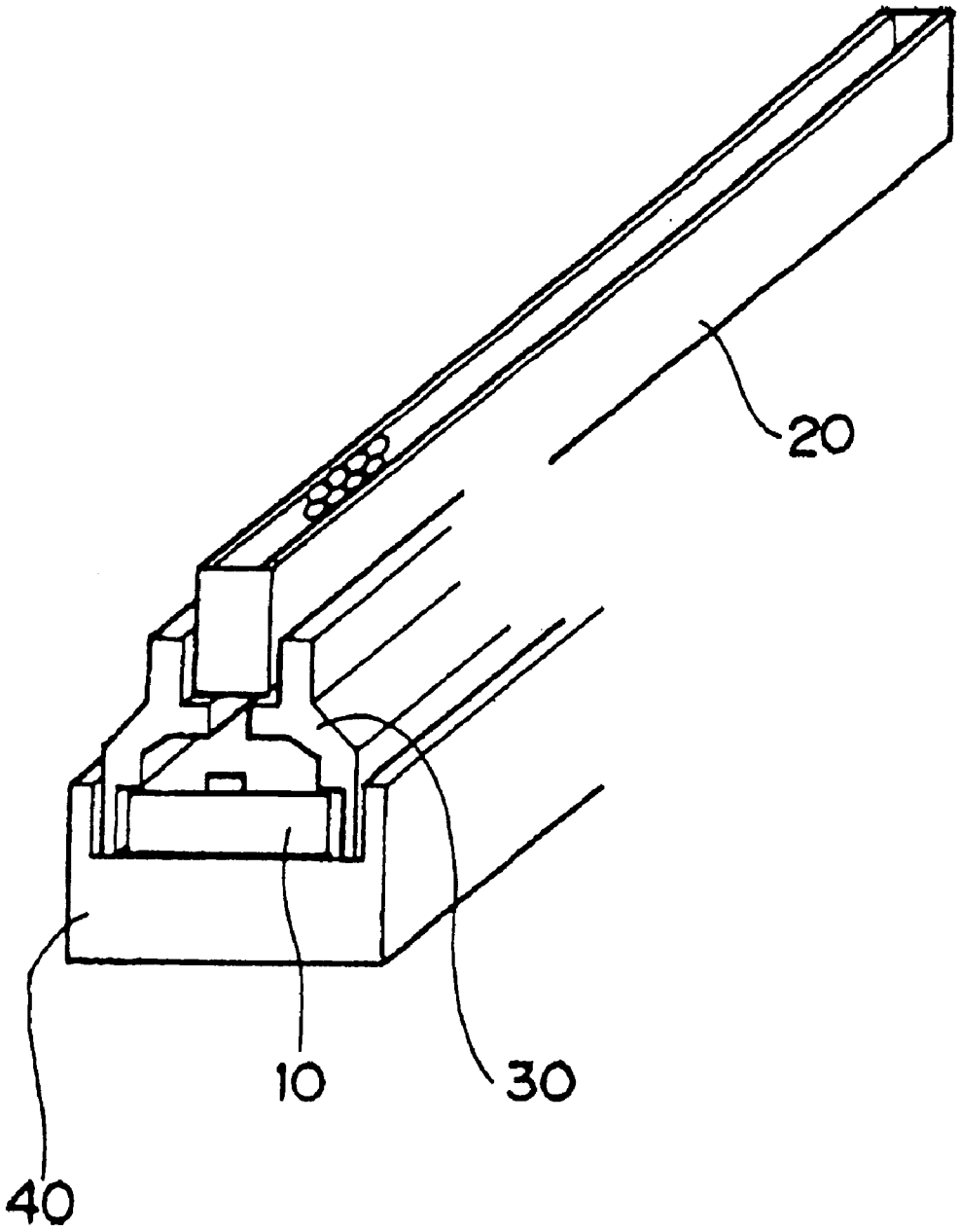
FIG. 3 is a schematic perspective view of an LED optical exposure device as used in the present invention.
Figure 4:
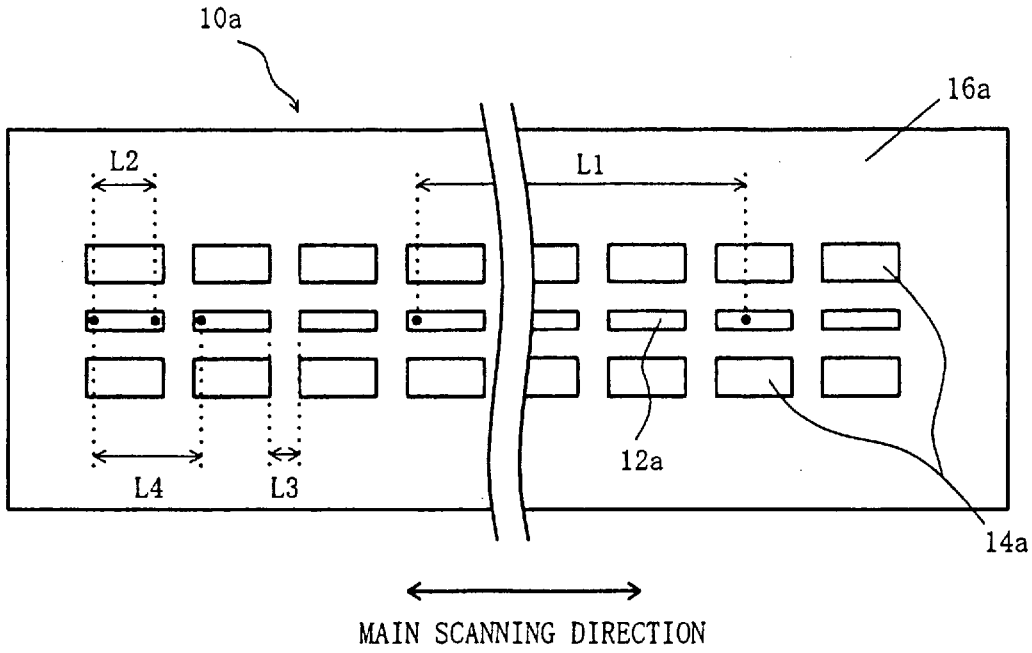
FIG. 4 is a schematic plan view of an LED array 10*a* used for an exposure device 100*a* of the image-forming unit 200*a* shown in FIG. 1.

The exposure device 100 uniformly charges the photosensitive drum 210 (e.g., at −600 V). Any exposure methods known in the art (e.g., the mechanical scanning method and stationary scanning method) can be adopted. In the present embodiment, however, the stationary scanning method that requires no movable section corresponding to a main scanning direction (a direction perpendicular to a sheet conveying direction), and has a simple mechanism is adopted. The exposure device 100, as shown in FIG. 3, includes an LED array 10 as a light source, a SELFOC™ lens array 20, a lens support 30, and a frame 40. FIG. 3 is a schematic perspective view illustrating the exposure device 100 using the inventive LED. FIG. 4 is a structural schematic view of an LED array 10a provided in an exposure device 100*a* for forming a black image, and FIG. S is a schematic view for explaining a structure of LED arrays 10*b* through 10*d* provided in exposure devices 100*b* through 100*d*.

The LED array 10*a* shown in FIG. 3 includes an LED chip 12*a*, and a pair of driving circuits (Dr-IC) 14*a* that is placed so as to sandwich the LED chip 12*a*, on a print plate 16*a* made, for instance, of platinum or the like, as shown in FIG. 4. Each driving circuit 14*a* has the same width as the corresponding LED chip 12*a*, and is aligned in a vertical direction as shown in FIG. 4. Each LED chip 12*a* has 128 LEDs (light-emitting diodes: dots), which emit light, thereby exposing the photosensitive drum 210 to light through SELFOC™ lens array 20. Since the LED array 10*a* has 60 LED chips 12*a*, total 7, 680 dots of LEDs are made available for exposure to light.

Figure 5:
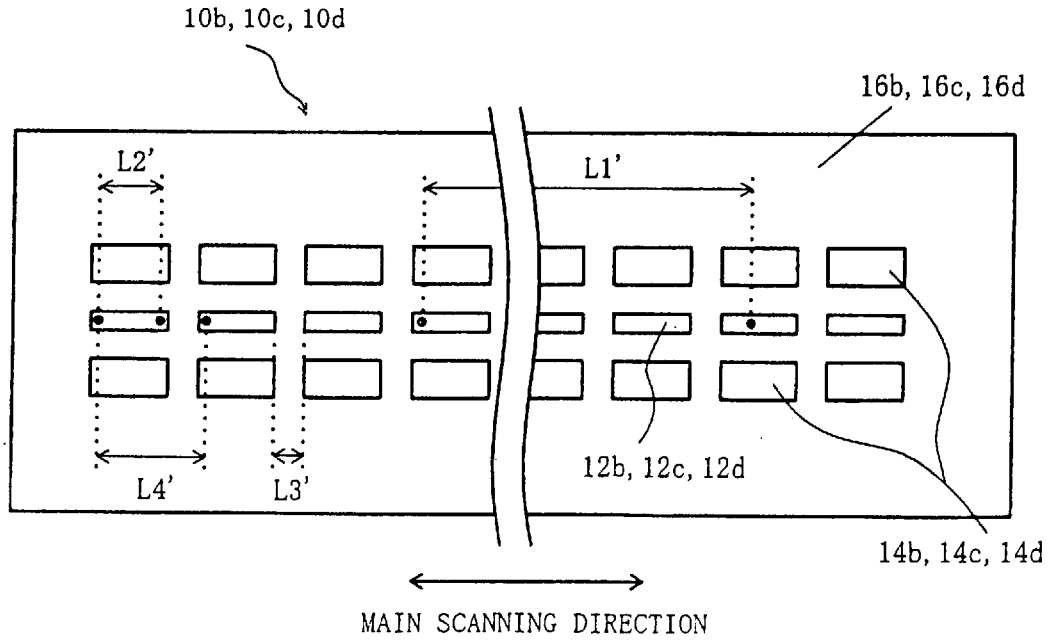
FIG. 5 is a schematic plan view of an LED arrays 10*b* to 10*d* used for exposure devices 100*b* to 100*d* of the image-forming units 200*b* to 200*d* shown in FIG. 1.

As the LED arrays 10*b* through 10*d* shown in FIG. 5 also have the same components as the LED array 10*a*, a duplicated description will be omitted.

As may be readily understood, the image-forming unit 200*a* is located nearest to the fixer 330, and thereby the exposure device 100*a* is most conspicuously expanded by radiant heat from the fixer 330 in comparison with other exposure devices 100*b* through 100*d*.

To be more specific, each exposure device 100*a* through 100*d* has approximately the same temperature when printing is initiated after power is turned on or during continuous printing. Each exposure device 100*a* through 100*d* has room temperature when printing is initiated after power is turned on, while the fixer 330 has temperature at which fixing is possible, e.g., at 170° C. However, printing operation is initiated immediately after power is turned on, so that radiant heat from the fixer 330 has little effect. Consequently, the exposure device 100*a* is not so much affected by a thermal expansion, and thus the exposure devices 100*a* through 100*d* have approximately the same temperature.

Thereafter, as continuous printing is commenced, the LED arrays 10*a* through 10*d* provided in each exposure device 100*a* through 100*d* rises in temperature by light emission for exposure. However, since similar heat is produced in every device, there occurs no large temperature difference among the exposure devices 100*a* through 100*d*, and the effect of the difference of their thermal expansions is negligible.

During an idle period after continuous printing finishes temperature of the exposure device 100*a* is higher than that of the exposure devices 100*b* through 100*d*. The idle period by which we mean is while the device runs at idle for the sake of energy conservation if no print data comes from an upstream device for a specified period since the last print data has been processed. During such an idle period, the fixer 330 on standby in preparation for the next printing maintains temperature at about 120° C. The exposure device 100*a* nearest to the fixer 330 thus rises in temperature by about 10° C. relative to the other exposure devices 100*b* through 100*d* by the influence of a radiant heat generated from the fixer 330. As a result, the difference of thermal expansions in the LED arrays 10*a* through 10*d* becomes nonnegligible.

In the exposure devices 100*a* through 100*d*, portions that thermally expand are mainly the LED arrays 10*a* through 10*d*. For instance, the print plates 16*a* through 16*d* of the LED arrays 10*a* through 10*d* thermally expand at about 3ì m/° C. Accordingly, if a temperature difference of about 10° C. occurs between the exposure device 100*a* and the exposure devices 100*b* through 100*d*, a displacement of about 30 mm occurs. As described above, a multicolor image is formed by superimposed colors, so that a misalignment of dots by the thermal expansion may cause misregistration of color images, preventing a high-precision multicolor image from being formed. Such a misalignment of dots occurs wholly or partly depending upon the location of the exposure device 100*a* and the fixer 330. Therefore, if the LED array 10*a* is configured to have the same size as the other LED arrays 10*b* through 10*d*, a difference of a thermal expansions between the LED array 10*a* and the LED arrays 10*b* through 10*d* would become so large as nonnegligible, especially when printing resumes after an idle period ends. The misalignment of dots among the LED arrays 10*a* through 10*d* should be maintained below about 80 mm, preferably below 20 mm for obtaining a high-quality image.

Figure 10:
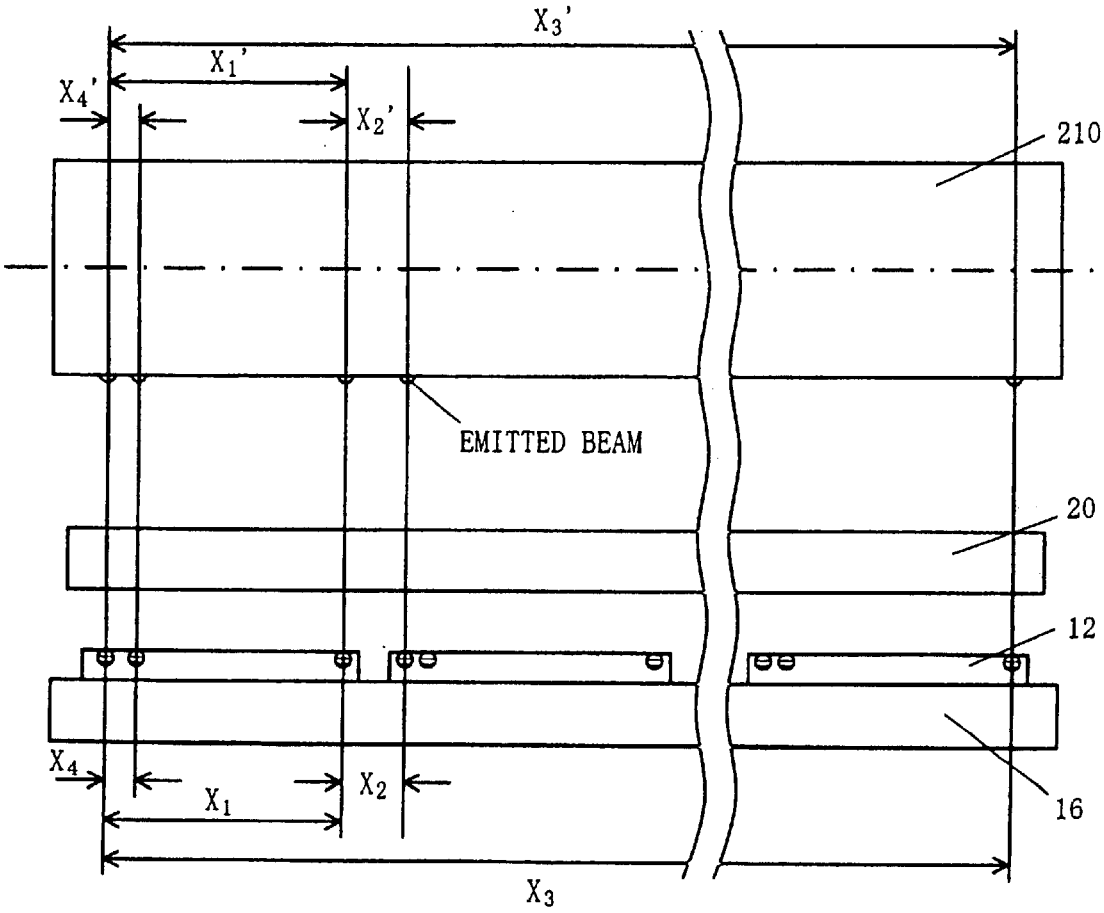
FIG. 10 is a schematic sectional view for explaining a relative position of an exposure device and photosensitive drum, and a dot irradiation.

Thus, in the present invention, an interval between dots of the LED array 10*a* is preset to be smaller than that of the LED arrays 10*b* through 10*d* by ascertaining the amount of the thermal expansion in the LED array 10*a*. Referring to FIGS. 4, 5 and 10, several methods exist, as will be explained later, for shortening the interval between dots of the LED array 10*a*. FIG. 10 is a schematic sectional view for explaining an influence that a relative position of the exposure device 100 and the photosensitive drum, and the interval between dots in the LED array 10 may exert on the photosensitive drum 210.

A first method is to select any number of dots in any places in the LED array 10*a* and to configure an interval L1 between the dots to be smaller than an interval L1' between the corresponding dots in the LED arrays 10*b* through 10*d* (i.e., L1'>L1). Since the dots are selected from "any places", the interval L1 may be shortened only in a middle area of the LED array 10*a*, for example, if the middle area is particularly subject to a thermal expansion, while L1 may be configured to be an interval between dots 13*a* at start and end points (equivalent to $X_3$ in FIG. 10), if its whole area may uniformly expands by heat. The latter interval L1 corresponds to a printing width. The same is true in second and third methods. The "interval L1' between the corresponding dots" should be applied to the dots in the same numbers and places as the interval L1 between the dots. L1 and L1' are equivalent to an interval of any combination of a chip width (or an interval in the chip) and a chip spacing as will be described later. Referring to FIG. 10, for example, if L1 and L1' is configured to be $X_3$, they are reflected in an interval $X_3$' on the photosensitive drum 210. Thus, a misalignment on the photosensitive drum may adopt $X_3$' as a reference interval.

A second method is to select any dots 13*a* in one or more LED chips 12*a* in any places and to configure an interval L2 between the dots to be smaller than an interval L2' between the corresponding dots in the LED arrays 10*b* through 10*d*(i.e., L2'>L2). L2 may be configured, for example, to be a maximum interval $X_1$ between dots or an interval $X_4$ between adjacent dots in the chip. It is to be understood that these intervals may in turn be reflected in an interval $X_1$' or $X_4$' on the photosensitive drum 210 and that a misalignment on the photosensitive drum 210 may adopt them as a reference interval. The second method can be achieved by adjusting a mask width in a lithographic operation as carried out in a semiconductor fabrication process. The "interval L2' between the corresponding dots" should be applied to the dots in the same numbers and places as the interval L2 between the dots. L2 and L2' are equivalent to a width of the LED chip 12 (or an interval in the chip).

A third method is to configure an interval (spacing) L3 between an adjacent LED chips 12*a* in any places to be smaller than an interval L3' (equivalent to $X_3$ in FIG. 10) between the corresponding chips in the LED arrays 10*b* through 10*d* (i.e., L3'>L3). The third method can be achieved by adjusting the spacing of an arrangement of the LED chips 12*a*. The "interval L3' between the corresponding chips" should be applied to the chips in the same numbers and places as the interval L3 between the chips. The interval L3' as shown in FIG. 5 is, for instance, 42.3±5ì m. L3 and L3' are equivalent to a spacing between the LED chips 12*a*, and it is to be understood that these intervals may in turn be reflected in an interval X2' on the photosensitive drum 210 and that a misalignment on the photosensitive drum 210 may adopt them as a reference interval.

A fourth method is to configure an interval L4 which is obtained by combining a width of the LED chip 12*a* in any places and an interval between the chips to be smaller than a corresponding interval LA' in the LED arrays 10*b* through 10*d* (i.e., LA'>L4). The "corresponding interval L4'" should be applied to a total interval of the width and spacing of the chips in the same places as the interval L4. The interval L4' as shown in FIG. 5 is, for instance, 5.414 mm. Since L4 (and L4') is equivalent to an interval obtained by adding an interval between the chips to the width of the LED chips 12*a*, it may become the same as L1 (and L1') depending upon its combination. Moreover, if the relationship of L4'>L4 is satisfied, either the width or spacing of the chips may be shortened.

Figure 6:
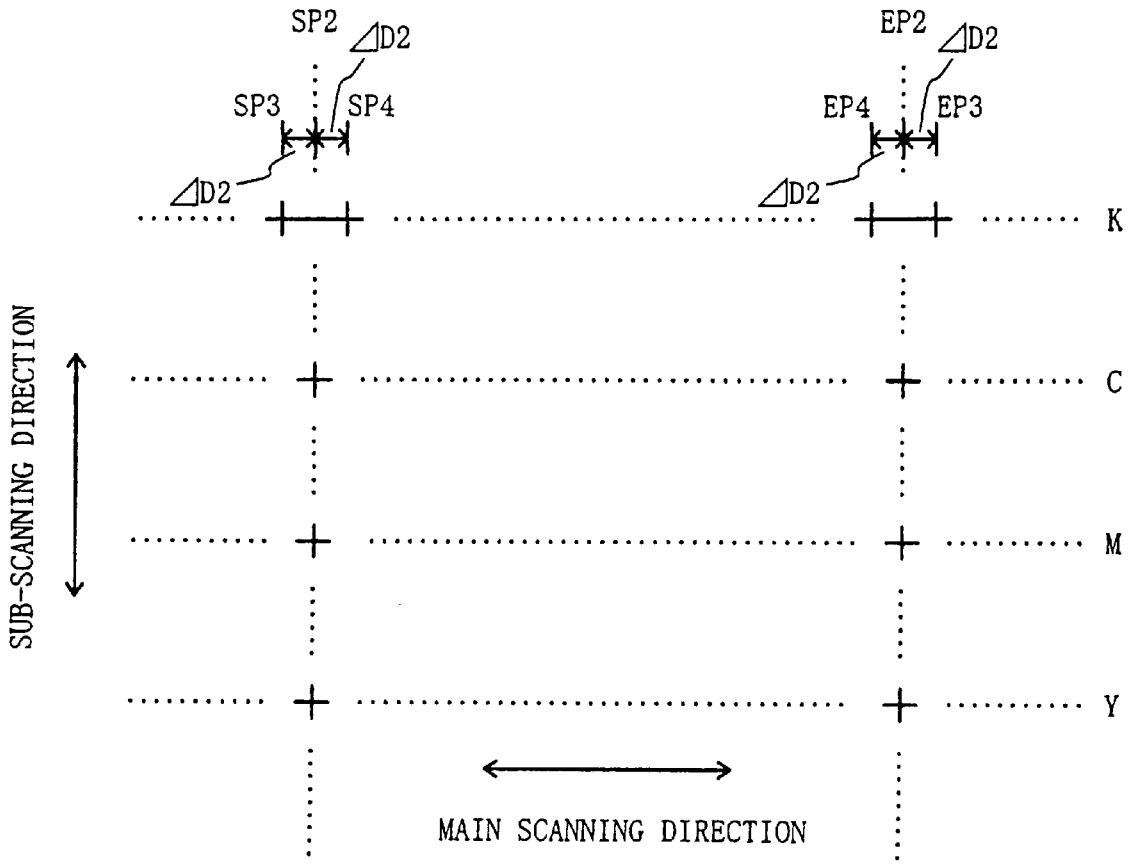
FIG. 6 is a conceptual illustration of an image formed by the multicolor image-forming device shown in FIG. 1.
Figure 7:
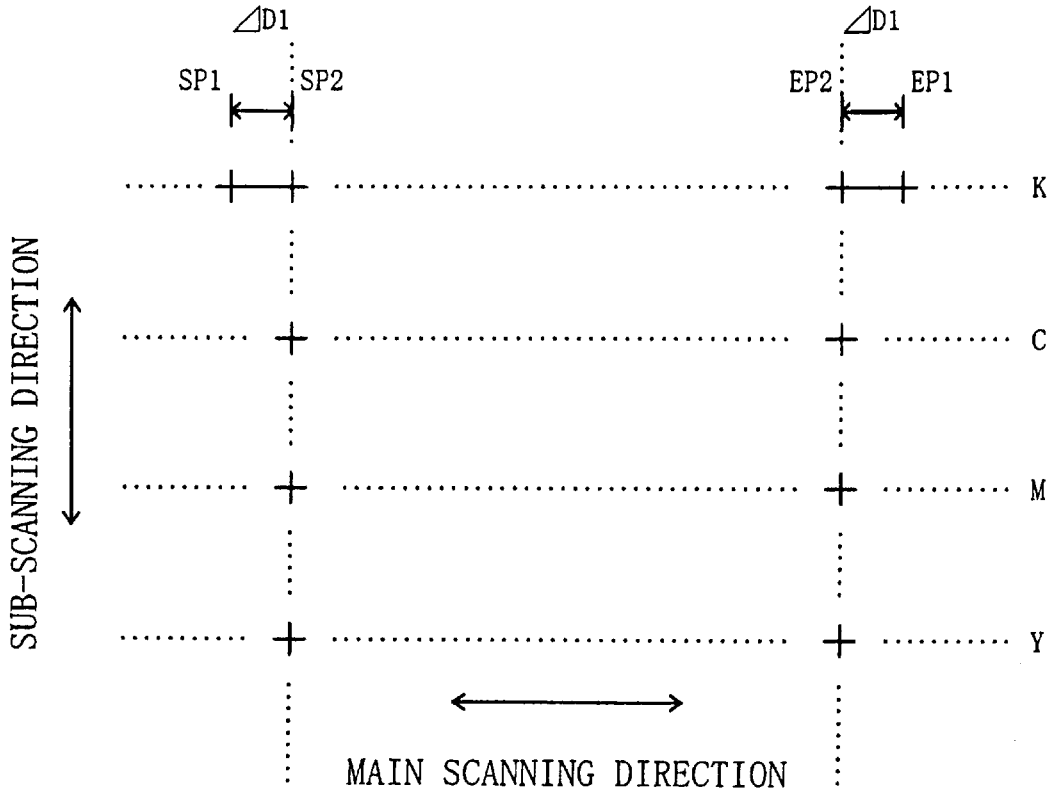
FIG. 7 is a conceptual illustration of an image formed by a multicolor image-forming device in contrast to FIG. 6

A description will now be given of effects of reduced color deviation according to the inventive image-forming device 300 with reference to FIGS. 6 and 7. FIG. 6 is a conceptual illustration of an image formed by the image-forming device 300 shown in FIG. 1. FIG. 7 is a conceptual illustration of an image formed by an image-forming device in contrast to FIG. 6. In FIGS. 6 and 7, each start position (SP) and end position (EP) of a certain image along a main scanning direction is displaced with respect to four colors (K, C, M and Y) to a sub-scanning direction (or sheet conveying direction) for explanation purposes. The image-forming device that forms the image shown in FIG. 7 has the same configuration as the image-forming device 300 as shown in FIG. 1 except that the exposure device 100*a* is the same as the exposure devices 100*b* through 100*d*. Thus, the image-forming device that forms the image shown in FIG. 7 includes the same LED arrays 10*a* through 10*d* as in FIG. 1.

According to the image shown in FIG. 7, C, M and Y are placed in proper alignment at SP2 and EP2, in cases during printing operation immediately after power is turned on, during continuous printing, and during printing operation immediately after an idle period. However, K is placed at SP1 and EP1 each displaced outward by ÄD1 from SP2 and EP2 during printing operation immediately after an idle period due to a thermal expansion by residual heat in a fixing section, though placed in proper alignment with C, M and Y at SP2 and EP2 in cases during printing operation immediately after power is turned on, and during continuous printing.

On the other hand, according to the image shown in FIG. 6, C, M and Y are placed in proper alignment at SP2 and EP2, in cases during printing operation immediately after power is turned on, during continuous printing, and during printing operation immediately after an idle period. However, K is placed at SP4 and EP4 each displaced inward by ÄD2 from SP2 and EP2, in cases during printing operation immediately after power is turned on, and during continuous printing, while K is placed at SP3 and EP3 each displaced outward by ÄD2 from SP2 and EP2 during printing operation immediately after an idle operation. In a preferred embodiment, the equation ÄD1=2ÄD2 is satisfied.

According to the present embodiment, the start and end positions of the K image are always displaced with respect to the C, M and Y images, but a maximum amount of the displacement is less than ÄD1.

The LED array 10*a* according to the present embodiment can be manufactured by using a small mask or otherwise as described above. However, it is a practicable alternative to manufacture a lot of LED arrays 10 by undergoing a process permitting a certain range of errors in size, so that the LED array 10*a* and the other LED arrays 10*b* through 10*d* are obtained owing to its manufacturing errors. This manufacturing method utilizes the following fact: if a certain interval between dots is predetermined, and a lot of similar LED arrays 10 are manufactured in such a manner as to have the predetermined interval between dots, then a normal distribution in which a maximum value is exhibited where a manufacturing error is zero with respect to the interval between dots can be obtained in general by actually measuring the intervals between dots. Therefore, the LED arrays 10 manufactured according to the above method may be classified into two groups: a first group of the LED arrays 10 featuring a determined manufacturing error of an interval between dots over the standard value; and a second group of the LED array 10 featuring a determined manufacturing error of an interval between dots below the standard value. Subsequently, the exposure devices 10*b* through 10*d* may be manufactured using the LED arrays belonging to the first group as the LED arrays 10*b* through 10*d*, and the exposure devices 10*a* may be manufactured using the LED arrays belonging to the second group as the LED arrays 10*a*. According to this method, the LED array 10*a* and the LED arrays 10*b* through 10*d* can be manufactured by the same manufacturing device, which requires only one set of manufacturing equipment, whereby the exposure devices 10*a* through 10*d* can be manufactured simply and inexpensively.

The SELFOC™ lens array 20 is a lens member storing a plurality of optical fibers that can form an unmagnified erect image. The lens support 30 is made of a resin member and supports the SELFOC™ lens array 20. The frame 40 is made of aluminum alloy or the like, and holds the LED array 10 and the lens support 30.

The development device 230 serves to visualize a latent image formed on the photosensitive drum 210 into a toner image. The development device 230 includes a development roller 232, a reset roller 234, and a toner cartridge 236. In the present embodiment, toner of four colors such as cyan (C), magenta (M), yellow (Y), and black (K) is used for a developer as an example. The developer may include one or two components (i.e., it may include a carrier) without distinction as to whether it is magnetic or nonmagnetic. The toner cartridge 236 stores toner and supplies toner to the reset roller 234. The reset roller 234 comes into contact with the development roller 232, and supplies toner to the development roller 232. The reset roller 234 is placed in or out of contact with the photosensitive drum 210, and supplies toner to the photosensitive drum 210 by electrostatic force. Consequently, a toner image is formed on the photosensitive drum 210. Unused toner remaining on the development roller 232 is collected by the reset roller 234 and brought back into the toner cartridge 236.

The transfer roller 240 generates an electronic field to electrostatically adsorb toner, and transfers the toner image adsorbed on the photosensitive drum 210 onto the paper P.

After the transfer, the cleaning section 250 collects and disposes of toner remaining on the photosensitive drum 210, or as necessary returns the toner collected by the screw conveyor 260 to the toner cartridge 236. The cleaning section 250 also serves to collect debris on the photosensitive drum. The cleaning section 250 may utilize varied kinds of means including magnetic force and rubber friction to remove the toner and charges on the photosensitive drum 210.

The fixer 330 serves to permanently fix a toner image (toner layer) onto the paper P. The transferred toner is adhered onto the paper P only with a weak force, and thus easily fallen off. Therefore, the fixer fuses the toner by pressure and heat to imbue the paper P with the toner. Energy for fixing the toner layer required to form a multicolor image is greater than that required to form a single-color image. The stacker 342 provides a space for dispensing the paper P after printing is completed.

To illustrate an action of the multicolor image-forming device 300 of the present invention, a sheet placed on the top of one or more sheets of paper P in the hopper 312 is dispensed by the pickup roller 314, and guided by the sheet guide 316 to the conveyor path 342. Thereafter, the paper P is conveyed by the sheet feed roller 322, the conveyor belt 342, and the driven roller 326 to image-forming devices 200*d*, 200*v*, 200*b*, and 200*a* in this sequence, to form toner layers of yellow, magenta, cyan, and black in this sequence according to a desired image. Subsequently, the toner layers are fixed onto the paper P by the fixer 330. The contour of the black toner layer is, as shown in FIG. 6, deviated from the toner layers of the other colors by ÄD2, which is smaller than ÄD1 and preferably satisfies ÄD2=ÄD1/2. Accordingly, a higher-quality image than that shown in FIG. 7 can be obtained, particularly in printing immediately after an idle period. The paper P on which the toner is fixed is dispensed to the stacker 344.

EXAMPLE

Results of an experiment for the image-forming device ass shown in FIGS. 6 and 7 are shown in Table 1 regarding temperature and intervals between dots immediately after power is turned on, immediately after an idle period, and immediately after a continuous printing. In the Table 1, K-Y is a difference of readings for the exposure devices K and M.

TABLE 1

| | | | EXPOSURE DEVICE Y | EXPOSURE DEVICE M | EXPOSURE DEVICE C | EXPOSURE DEVICE K | K–Y |
|---|---|---|---|---|---|---|---|
| TEMPERATURE [° C.] | JUST AFTER POWER ON | | 28.5 | 28.5 | 28.7 | 28.9 | 0.4 |
| | JUST AFTER IDLE | | 33.3 | 33.3 | 33.4 | 43.0 | 9.7 |
| | JUST AFTER CONTINUOUS PRINTING | | 38.7 | 38.8 | 39.5 | 46.4 | 7.7 |
| INTERVAL BETWEEN DOTS [mm] | JUST AFTER POWER ON | EXAMPLE OF FIG. 7 | 324.822 | 324.822 | 324.822 | 324.822 | 0.000 |
| | JUST AFTER IDLE | | 324.836 | 324.836 | 324.836 | 324.864 | 0.028 |
| | JUST AFTER CONTINUOUS PRINTING | | 324.853 | 324.853 | 324.854 | 324.875 | 0.022 |
| | JUST AFTER POWER ON | DEVICE 300 | 324.822 | 324.822 | 324.822 | 324.808 | 0.014 |
| | JUST AFTER IDLE | | 324.836 | 324.836 | 324.836 | 324.850 | 0.014 |
| | JUST AFTER CONTINUOUS PRINTING | | 324.853 | 324.853 | 324.854 | 324.861 | 0.008 |

As apparent from Table 1, each exposure device exhibits approximately the same temperature immediately after power is turned on, while only the exposure device K undergoes a sudden increase in temperature in cases immediately after an idle period and immediately after continuous printing. The degree of its temperature rise is over 7° C. compared with that of the exposure device Y that is farthest from the fixer. The difference of temperature between the exposure devices K and Y immediately after an idle period is greater than that immediately after continuous printing, because only the exposure K receives radiant heat and conductive heat from the fixer notwithstanding the exposure device itself produces no heat at idle and thus is cooled down over time.

In order to prevent color deviation properly, displacements of intervals between dots in each image-forming unit should be below 80ì m (spacing between both ends of 7,680 dots), and preferably below 20ì m. As shown in Table 1, in the image-forming device that forms the image as shown in FIG. 7, the color deviations between the development devices K and Y in cases immediately after power is turned on, immediately after an idle period, and immediately after continuous printing are respectively 0ì m, 28ì m, and 22ì m. Accordingly, it is to be interpreted that the color deviation of 28ì m for printing immediately after an idle period is particularly nonnegligible value in view of our targeting level for realizing a high-quality image formation.

On the contrary, in the image-forming device 300, the color deviations between the exposure devices K and Y in cases immediately after an idle period and immediately after continuous printing are respectively −14ì m, 14ì m, and 81 ì m. Accordingly, it is to be interpreted that the image-forming device 300 can provide high-quality images during each period of printing operation.

Although a description has been described as above of the image-forming device using an LED as a preferred embodiment of the present invention, the present invention is not limited to this and may cover, for instance, a device using an LD scanner unit.

Figure 9:
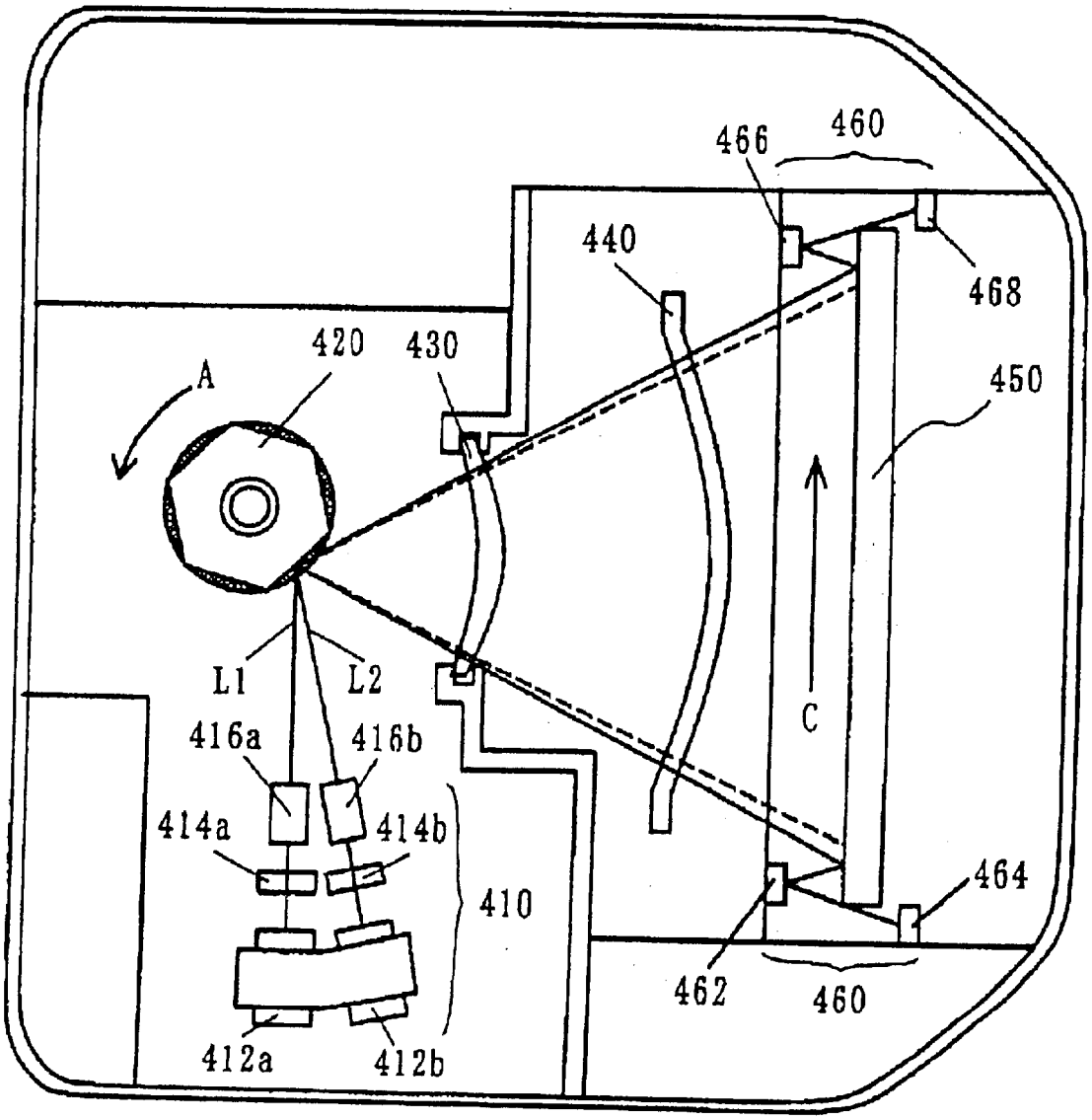
FIG. 9 is a structural schematic illustration for showing an optical unit provided in an LD scanner unit.

A description will now be given of one embodiment of the LD scanner unit with reference to FIG. 9. FIG. 9 is a structural schematic illustration for showing an optical unit provided in the LD scanner unit. The LD scanner unit includes an optical unit (development device) 400 shown in FIG. 9. The optical unit 400 shown in FIG. 9 is described in a senior application filed by the present applicant, Japanese Patent Application Laid-Open No. 10-260368. The optical unit includes a light source device 410, a polygon mirror 420, an f-è lens 430, a cylindrical lens 440, a plane mirror 450, and an exposure-positioning portion 460. In the present embodiment as shown in FIG. 9, each light source device 410 includes two exposure laser light sources 412. Generally speaking, the more light sources provided in the device, the higher image density and image-forming speed can be obtained, and thus high-resolution image formation and high-speed image formation can be realized.

The light source device 410 includes laser light source portions 412*a* and 412*b*, cylindrical lenses 414*a* and 414*b*, and beam shift devices 416*a* and 416*b*. Since two of the laser light sources 412 are provided as described above, the number of the lenses 414 and beam shift devices 416 is also two respectively. A variety of light sources may be used for the laser light source 412, such as a semiconductor laser, a gas laser, and an Ar laser. Different kinds of the light source may have different light emission wavelengths and light intensities, which range from 400 nm to 900 nm. The cylindrical lens 414 adjusts sectional shapes of beams L1 and L2 emitted from the light source portions 412. The beam shift device 416 adjusts optical path directions of the beams L1 and L2, and leads them to the polygon mirror 420. The laser light source 412 includes a laser diode that emits the beams L1 and L2, and a collimating lens that converts the beams into parallel beams.

The polygon mirror 420 is a polarizer comprised of rotatable faceted mirrors, and as shown in FIG. 9, provided with six-folded mirrors around a circumference of a regularly hexagonal plane plate, and spins at a few thousand rpm by a spindle motor (not shown). The polygon mirror 420 scans the photosensitive drum 210 in a direction indicated by an arrow C by a rotation in a direction indicated by an arrow A.

The f-è lens 430 is provided to correct a deflection aberration generated at the both ends of a scanning surface.

The cylindrical lens 440 corrects a surface tilt of beams emitted from the laser light source portion 412. The plane mirror 450 reflects the beams that have passed through the f-è lens 430 and the cylindrical lens 440, and forms an image on the photosensitive drum 210.

The exposure-positioning portion 460 includes a mirror 462, a beam sensor 464, a mirror 466, and a CCD sensor 468. The mirror 462 serves to reflect a beam at the time of starting scanning for exposure to the beam sensor 464. The beam sensor 464, which is comprised of a photo diode, serves to produce a detection signal when receiving a beam and transmit the signal to a control system. The mirror 466 serves to reflect a beam at the time of ending scanning for exposure to the CCD sensor 468. The CCD sensor 468 produces a detection signal when receiving a beam, and transmits the signal to the control system.

To illustrate an operation of the optical system 400, when the beams L1 and L2 are emitted from the laser light source portions 412, the beams L1 and L2 are reflected by the polygon mirror that is rotating in the direction of the arrow A. The beams L1 and L2 that have been reflected travel through the f-è lens 430, cylindrical lens 440, and plane mirror 450, and are first received by the beam sensor 464. Next, the beams L1 and L2 scan on the photosensitive drum 210 in the direction of the arrow C as the polygon mirror 420 rotates, travel through the mirror 466, and are lastly received by the CCD sensor 468.

During one cycle of the above scanning process, when a detection signal from the beam sensor 464 that has received the beams L1 and L2 is input into the control system (not shown), the control system, synchronized with the signal, modulates the beams L1 and L2 as a video signal for a predetermined print period. After the print period ends, the control system that has received the detection signal from the CCD sensor 468 receiving the beams L1 and L2, as necessary, instructs the beam shift device 416 to correct a beam pitch.

A description will be given of a print operation in the control system that is not shown in FIG. 9. Hereupon, a signal that instructs the laser light source 412 to emit a beam is referred to as signal BN; a signal that is transmitted from the beam sensor 464 to the control system as signal BD; and a signal transmitted from a video signal generator (not shown) as signal VD. As the polygon mirror 420 rotates with a uniform speed by a motor (not shown), the signal BN is transmitted from the control system to the laser light source portion 412 to detect a timing of starting scanning. Synchronized with the signal BN, the laser light source portion 412 emits a beam with uniform intensity.

When the beam sensor 464 receives the beams L1 and L2, the signal BD from the beam sensor 464 is input to the control system. Accordingly, the control system turns the signal BN OFF. After a predetermined period, the control system outputs the video signal VD for printing from the video signal generator to the laser light source portion 412. Then, the signal VD is converted into serial video signal VD1 and VD2 each covering one scanning, which are output respectively to the laser light source portions 412*a* and 412*b*.

The laser light source portions 412*a* and 412*b* emit a light for printing that is modulated by the video signals VD1 and VD2. The polygon mirror 420 scans the light on a print area of the photosensitive drum 210. Such a scanning operation is repeated, and an electrostatic latent image is formed on the photosensitive drum 210. A relative positioning of the beams L1 and L2 emitted from the optical unit 400 and the photosensitive drum, and the dot emission are like the schematic sectional view shown in FIG. 10.

In the foregoing LD scanner unit, the f-è lens 430, the cylindrical lens 440, and the plane mirror 450 have manufacturing tolerances, by which a beam emission point on the photosensitive drum is likely to be deviated. Further, the laser light source portion 412, or others, like the LED array 10, may possibly expand by heat, which may cause a deviation of a beam emission point. Therefore, as the foregoing embodiment, changing spaces between dots in the light source in use may reduce a deviation of a beam emission point. It is thus possible to provide a high precision image quality regardless of any influences of tolerances and thermal expansions.

Although the preferred embodiments of the present invention have been described above, various modifications and changes may be made in the present invention without departing from the spirit and scope thereof.

As described above, according to the exposure device and the image-forming device including the same as one exemplified embodiment of the present invention, a high-quality image with reduced color deviations can be obtained. In addition, the manufacturing method as one exemplified embodiment of the present invention makes it possible to manufacture the above-said exposure device and image-forming device by using the same equipment at the same cost as conventional devices.

What is claimed is:

1. An exposure device comprising:

a first exposure unit that emits a plurality of dots at a first interval between the dots onto a photoreceptor material; and a second exposure unit that emits a plurality of dots at a second interval between the dots different from said first interval between the dots onto said photoreceptor material, wherein said interval between the dots in a specified area of said second exposure unit is made shorter than said interval between the dots in an area of said first exposure unit corresponding to said specified area.

2. An exposure device according to claim 1, wherein an absolute value of a difference between said first and second intervals is set to a half of a thermally expandable maximum distance if said first exposure unit is placed a position where said second exposure unit is placed.

3. An exposure device according to claim 1, wherein said second exposure unit is placed closer to a heat generating body than said first exposure unit.

4. An exposure device according to claim 1, wherein said exposure device is an LED head.

5. An exposure device according to claim 1, wherein said exposure device is an LD scanner unit.

6. An exposure device according to claim 1, wherein said first and second intervals of the dots correspond to a printing width.

7. An exposure device according to claim 1, wherein said second exposure unit is for printing black-color images.

8. An exposure device comprising:

a first exposure unit that emits a plurality of dots at a first interval between the dots onto a photoreceptor material; and a second exposure unit that emits a plurality of dots at a second interval between the dots different from said first interval between the dots onto said photoreceptor material, wherein an interval between the dots in a chip of said second exposure unit is made shorter than a corresponding interval between the dots in a corresponding chip of said first exposure unit.

9. An exposure device comprising:

a first exposure unit that emits a plurality of dots at a first interval between the dots onto a photoreceptor material; and a second exposure unit that emits a plurality of dots at a second interval between the dots different from said first interval between the dots onto said photoreceptor material, wherein an interval between two adjacent chips of said second exposure unit is made shorter than an interval between corresponding two adjacent chips of said first exposure unit.

10. An image-forming device comprising:

a photosensitive body;

an exposure device that exposes said photosensitive body to light and forms a latent image; and a fixing device that fixes a toner image corresponding to said latent image onto a recordable medium, wherein said exposure device comprises:

a first exposure unit that emits a plurality of dots at a first interval between the dots onto a photoreceptor material; and a second exposure unit that emits a plurality of dots at a second interval between the dots different from said first interval between the dots onto a photoreceptor material, wherein said interval between the dots in a specified area of said second exposure unit is made shorter than said interval between the dots in an area of said first exposure unit corresponding to said specified area.

11. An image-forming device according to claim 6, wherein the absolute value of a difference between said first and second intervals is set to a half of a thermally expandable maximum interval if said first exposure unit is placed at a position where said second exposure unit is placed.

12. A image-forming device according to claim 6, wherein said second exposure unit is placed closer to a heat generating body than said first exposure unit.

13. An image-forming device according to claim 10, wherein said exposure device is an LED head.

14. An image-forming device according to claim 10, wherein said exposure device is an LD scanner unit.

15. An image-forming device according to claim 10, wherein said first and second intervals of the dots correspond to a printing width.

16. An image-forming device according to claim 10, wherein said second exposure unit is for printing black-color images.

17. An image-forming device comprising:

a photosensitive body;

an exposure device that exposes said photosensitive body to light and forms a latent image; and a fixing device that fixes a toner image corresponding to said latent image onto a recordable medium, wherein said exposure device comprises:

a first exposure unit that emits a plurality of dots at a first interval between the dots onto a photoreceptor material; and a second exposure unit that emits a plurality of dots at a second interval between the dots different from said first interval between the dots onto a photoreceptor material, wherein an interval between the dots in a chip of said second exposure unit is made shorter than a corresponding interval between the dots in a corresponding chip of said first exposure unit.

18. An image-forming device comprising:

a photosensitive body;

an exposure device that exposes said photosensitive body to light and forms a latent image; and a fixing device that fixes a toner image corresponding to said latent image onto a recordable medium, wherein said exposure device comprises:

a first exposure unit that emits a plurality of dots at a first interval between the dots onto a photoreceptor material; and a second exposure unit that emits a plurality of dots at a second interval between the dots different from said first interval between the dots onto a photoreceptor material, wherein an interval between two adjacent chips of said second exposure unit is made shorter than an interval between corresponding two adjacent chips of said first exposure unit.

* * * * *